US010400436B2

(12) United States Patent
Steylaerts et al.

(10) Patent No.: US 10,400,436 B2
(45) Date of Patent: Sep. 3, 2019

(54) DRAIN ASSEMBLY, DRAIN BODY FOR USE IN SUCH AN ASSEMBLY AND ODOR TRAP OF USE IN SUCH AN ASSEMBLY

(71) Applicant: DE DENKFABRIEK BVBA, Berlaar (BE)

(72) Inventors: Peter Steylaerts, Hulshout (BE); Patrick Steylaerts, Itegem (BE)

(73) Assignee: DE DENKFABRIEK BVBA, Berlaar (BE)

( * ) Notice: Subject to any disclaimer, the term of this patent is extended or adjusted under 35 U.S.C. 154(b) by 0 days.

(21) Appl. No.: 15/524,010

(22) PCT Filed: Nov. 3, 2015

(86) PCT No.: PCT/EP2015/075545
§ 371 (c)(1),
(2) Date: May 3, 2017

(87) PCT Pub. No.: WO2016/071318
PCT Pub. Date: May 12, 2016

(65) Prior Publication Data

US 2017/0314252 A1 Nov. 2, 2017

(30) Foreign Application Priority Data

Nov. 3, 2014 (BE) ..... 2014/5048

(51) Int. Cl.
*F16K 13/10* (2006.01)
*E03F 5/04* (2006.01)
*E03C 1/284* (2006.01)

(52) U.S. Cl.
CPC ..... *E03F 5/0408* (2013.01); *E03C 1/284* (2013.01); *E03F 2005/0416* (2013.01)

(58) Field of Classification Search
CPC ..... E03F 5/0408; E03F 2005/0416; E03C 1/284; Y10T 137/4456; Y10T 137/4463;
(Continued)

(56) References Cited

U.S. PATENT DOCUMENTS 4,092,747 A * 6/1978 Kessel ..... E03F 5/0405 4/286
4,198,717 A * 4/1980 Kessel ..... E03F 5/0404 137/247.11
(Continued)

FOREIGN PATENT DOCUMENTS

BE 1018522 A5 2/2011
FR 2942820 A1 9/2010
(Continued)

OTHER PUBLICATIONS

Belgium Search Report for corresponding Belgium Application No. 2014/05048, dated Aug. 20, 2015.
(Continued)

*Primary Examiner* — Minh Q Le
(74) *Attorney, Agent, or Firm* — Workman Nydegger

(57) ABSTRACT

The invention pertains to an odor trap, which comprises a first drainage channel situated between an inlet and an outlet, comprising, viewed in the flow direction, a first closing wall for the closing off of an uppermost part of the drainage channel and a second closing wall for the closing off of a lowermost part of the first drainage channel. The first and second closing walls, viewed in a horizontal direction, overlap. The odor trap comprises an elongated main body. The inlet substantially extends over the length of a first planar surface of the main body, which first planar surface is determined by the first closing wall. The second closing wall is situated in the main body. The outlet is situated in a second
(Continued)

planar surface, situated opposite the first planar surface. The invention also pertains to a drain body and a drain assembly.

12 Claims, 8 Drawing Sheets

(58) Field of Classification Search
CPC ..... Y10T 137/4531; Y10T 137/4576; Y10T 137/4583
USPC ..... 137/247.41, 247, 247.11, 247.29; 4/679, 4/613, 671, 672, 673, 681
See application file for complete search history.

(56) References Cited

U.S. PATENT DOCUMENTS

| | | | | |
|---|---|---|---|---|
| 4,275,760 | A * | 6/1981 | Kessel | E03F 5/0405 137/546 |
| 5,192,156 | A * | 3/1993 | Webb | E03F 5/0405 137/247.49 |
| 5,379,749 | A * | 1/1995 | Rieke | F24H 8/006 110/203 |
| 2002/0057944 | A1* | 5/2002 | Adams | B01D 17/0208 405/39 |
| 2005/0223485 | A1* | 10/2005 | Nijhof | E03F 5/0408 4/613 |
| 2009/0126102 | A1* | 5/2009 | Schluter | E03C 1/28 4/679 |
| 2011/0067175 | A1 | 3/2011 | Steylaerts et al. | |
| 2016/0130794 | A1* | 5/2016 | Erlebach | E03F 5/0408 4/613 |

FOREIGN PATENT DOCUMENTS

| | | |
|---|---|---|
| NL | 1025765 C2 | 9/2004 |
| NL | 1027800 C2 | 6/2006 |

OTHER PUBLICATIONS

International Preliminary Report on Patentability and Written Opinion for corresponding International PCT Application No. PCT/EP2015/075545, dated Sep. 30, 2016.
International Preliminary Report on Patentability for corresponding International PCT Application No. PCT/EP2015/075545, dated Nov. 14, 2016.
International Search Report for corresponding International PCT Application No. PCT/EP2015/075545, dated Feb. 16, 2016.

* cited by examiner

DRAIN ASSEMBLY, DRAIN BODY FOR USE IN SUCH AN ASSEMBLY AND ODOR TRAP OF USE IN SUCH AN ASSEMBLY

BACKGROUND

The present invention relates to a drain assembly and an odor trap for such a drain assembly, in particular for use in a walk-in shower.

For aesthetic reasons and to maximize the usable surface of the bottom of walk-in shower, the visible components of drain assemblies for walk-in showers after being built-in are preferably elongated and as narrow as possible. Such an elongated drain assembly is known from BE 1018522 A5 in the name of N.V. Steylaerts and is commercialized under the tradename "Carrodrain". After building-in of the "Carrodrain" in the floor only an elongated grating with a width of ca. 56 mm is visible.

There is a need for drain assemblies with still narrower gratings.

The principle of an odor trap (also known as water trap or stench trap) is that a part of the channel through which the water runs away, is shaped in such a way that an obstacle in the channel together with the water present prevents bad smelling air from the drain side reaching the use side. According to the insight of the inventors the classical "swan neck" is not practicable for drains for walk-in showers, because as a result of its shape it is naturally no longer accessible after being built-in without breaking up the floor.

For these reasons walk-in showers make use of an odor trap comprising, viewed in the flow direction, a first closing wall for the closing off of the uppermost part of the drainage channel and placed at a distance from the first closing wall a second closing wall, wherein the first and second closing walls, viewed in a horizontal direction, overlap. Several ways of realizing such an odor trap in a horizontal tube component are described in Dutch patent NL 1027800 C2.

In the "Carrodrain" drain use is made of a removable odor trap with such a low height that it can be placed in a recess (collection zone) of the drain. The water to be drained off runs along the whole circumference of the odor trap to the inside. It is a disadvantage of this type of odor trap that it cannot be made narrower without a significant reduction in the drainage rate (in the case of pure scaling) or becoming mechanically less strong (in the case of making the walls thinner). Since this odor trap cannot be further miniaturized, it is also not possible to design a narrower drain assembly in which the odor trap can still be easily removed for cleaning or maintenance.

French patent application no. FR 2 942 820 A1, in the name of Wirquin Plastiques SA, discloses a shower drain having a main body with internal walls defining a gutter to receive water to be evacuated. The body has a longitudinal opening that ensures flow of water in the gutter. Passage forming units form a passage for evacuating the water from the gutter. A longitudinal wall canalizes the water towards a side of the gutter. Another longitudinal wall forms a water overflowing wall, and is intercalated between the former longitudinal wall and the passage forming units. The application further discloses an odor trap consisting of a first longitudinal wall that allows passage of water under its lower edge and a second longitudinal wall that allows passage of water over its upper edge. The second longitudinal wall is either part of the drain body, or of a separate gutter that must be installed prior to installing the part serving as the first longitudinal wall. Hence, FR 2 942 820 A1 does not disclose a self-contained, easily removable odor trap.

Dutch patent no. NL 1 025 765 C, in the name of Jered Nijhof, discloses a drain in a bathroom or shower cabin having an odor trap, a channel part, a base wall and upstanding long side walls. The odor excluder connects to the outlet aperture. The outlet aperture is located preferably in one of the long side walls. The outlet aperture is provided with a connecting muff for connection of the drain to the outlet connection. One of the long side walls is provided with a displaced, extending right-angled outer wall, which projects above the opening of the drain. The other long side wall is provided with a turned outstanding edge for connection of the drain to the floor surface. The channel part of the drain contains the odor trap, within which the outlet aperture of the drain is positioned. The odor trap consists of two upright transversal walls that extend over the width of the drain body and a corresponding lid that has downward edges that partially overhang the upright walls. Given the transversal orientation of the odor trap, the design of NL 1 025 765 A1 is adverse to a further reduction of the width of the drain, as this would proportionally reduce the flow capacity of the odor trap.

There is therefore a need for a compacter, particularly narrower, odor trap, that enables a high drainage rate to be realized and that after building-in of the drain body is still completely accessible and removable, such that it can be efficaciously cleaned and maintained.

SUMMARY

According to an aspect of the present invention, there is provided an odor trap for use in a drain assembly, which odor trap comprises a first drainage channel situated between an inlet and an outlet, comprising, viewed in the flow direction, a first closing wall for the closing off of an uppermost part of the drainage channel and a second closing wall placed at a distance from the first closing wall, for the closing off of a lowermost part of the first drainage channel, wherein the first and second closing walls, viewed in a horizontal direction, overlap; wherein the odor trap comprises an elongated main body; wherein the inlet substantially extends over the length of a first planar surface of the main body, which first planar surface is determined by the first closing wall; wherein the second closing wall is situated in the main body; and wherein the outlet is situated in a second planar surface of the main body, situated opposite the first planar surface.

The invention is inter alia based on the insight of the inventors that a narrower odor trap can be obtained by not allowing the water to flow in along all sides, but along only one side. The two closing walls which form the actual water trap, and the outside wall which connects to the drainage pipe, lie then in successive planes. The whole can thereby be produced in an advantageous way as a very narrow quasi-box-shaped or bar shaped element, which on the one hand makes a narrower drain possible, and on the other hand makes the insertion and removal of the odor trap into and out of the drain body very easy. The invention is additionally based on the insight of the inventors that through a judicious design of the inlet of the odor trap and of the collection zone of the drain body, an at least equally high drainage rate can be obtained as in known odor traps.

According to an embodiment of the odor trap according to the present invention, the main body is substantially box-shaped.

It is an advantage of this embodiment that the odor trap, due to the side planes being parallel to one another, can be easily fitted into the recess provided for that purpose in the drain body, and can also be easily removed again.

According to an embodiment of the odor trap according to the present invention, the distance between the first planar surface and the second planar surface is less than 20 mm.

It is an advantage of this embodiment that a drain assembly can be obtained in which the grating is no wider than 20 mm, while the odor trap can be easily removed and cleaned.

According to an embodiment of the odor trap according to the present invention, the height of the substantially box-shaped main body is less than 50 mm.

It is an advantage of this embodiment that the odor trap can be used in a drain body with a low height, which makes it possible to be built-in, where only limited overall height is available.

According to an embodiment of the odor trap according to the present invention the main body is provided with positioning means.

The positioning means can take any form, such as protrusions, grooves, studs, and such like. These positioning means work together with corresponding elements of the drain body, to ensure that the odor trap is inserted at the correct place, particularly with regard to a good seal between the outlet of the odor trap and the draining channel of the drain body.

According to an embodiment of the odor trap according to the present invention the outlet is round, and provided with a sealing means to make possible a water-tight connection with a drainage tube.

The sealing means is preferably a ring of a water-tight and compressible material, such as rubber or another elastomer. The seal means can also be an edge, groove, or flange, which connects to a ring of water-tight and compressible material on the drain body.

According to an embodiment the odor trap according to the present invention is provided with at least two compartments, which each have an inlet and an outlet, whereby the at least two compartments are situated abreast.

It is an advantage of this embodiment that a higher drainage rate can be realized, without the user or installer having to install multiple loose components. A single compartmentalized odor trap consists essentially of multiple odor traps next to one another in a single housing.

According to an aspect of the present invention, a drain body for building into a floor is provided, which drain body is provided with a recess for receiving an odor trap such as described above, wherein the recess is so configured that the or each outlet of the odor trap connects to a second drainage channel provided on the drain body, and wherein the drain body is so shaped that after it has been built-in, the odor trap can be removed from the recess.

It is an advantage of the drain body according to the invention that a very narrow drain can be obtained, from which the odor trap (also according to the invention) can also still be easily removed after building in, with a view to cleaning or maintenance.

In an embodiment of the drain body according to the present invention, the recess connects to a collection zone situated at the side of the inlet, which collection zone is situated at least partially under the floor covering after the drain body has been built in.

This embodiment is inter alia based on the insight of the inventors that the flow rate of the whole drain, for a given maximum odor trap flow rate, is determined by the speed with which the water to be drained off can be brought to the inlet of the odor trap. Otherwise than for the pre-existing odor traps, the water to be drained off can only run in along one side of the odor trap according to the invention. It is therefore an advantage of this embodiment that the water to be drained off, which runs in from different sides of the drain, is collected in the collection zone along the good side of the odor trap thence to flow with an optimal flow rate into the odor trap.

Since the collection zone connects to the recess in which the odor trap is inserted, it remains possible to clean the collection zone which is situated under the floor with a brush or a water jet, which can be inserted via the narrow opening for the insertion of the odor trap.

For the reason that this collection zone is at least partially under the floor covering after the drain body has been built in, the presence of this collection zone does not necessitate a broadening of the grating.

According to an aspect of the present invention, a drain assembly is provided comprising a drain body such as described above and an odor trap such as described above.

BRIEF DESCRIPTION OF THE DRAWINGS

These and other technical effects and advantages of embodiments of the present invention will be explained with reference to the enclosed drawings, wherein.

DETAILED DESCRIPTION OF VARIOUS EMBODIMENTS

Figure 1:
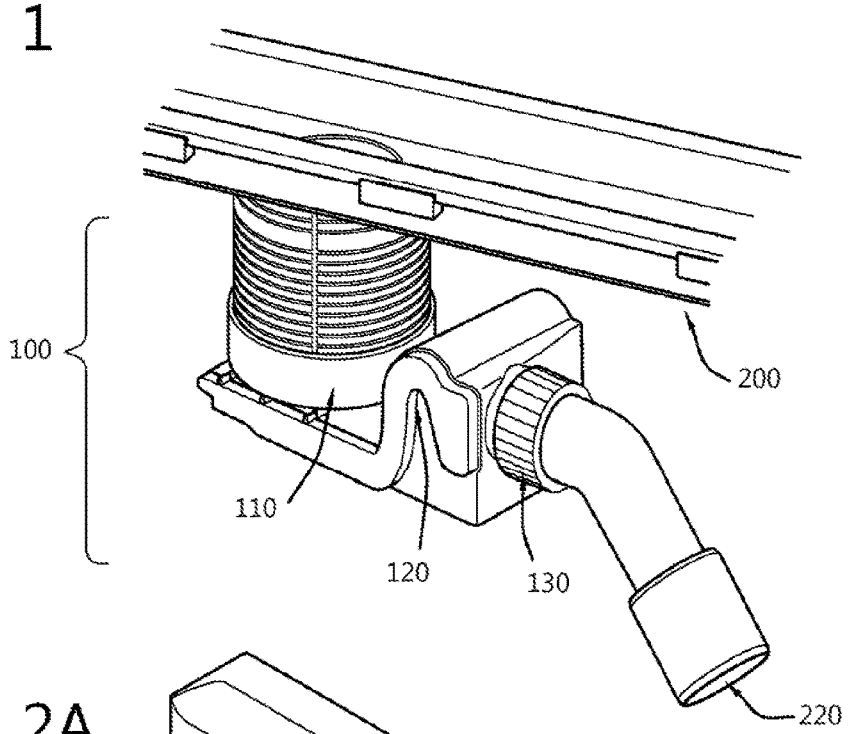
FIG. 1 shows a known odor trap of the "swan neck" type.

FIG. 1 shows a known odor trap of the "swan neck" type.

The illustrated odor trap 100 is placed under the drain body 200 (only shown in part), in such a way that the drain of the drain body is brought into the cylindrical inlet 110 of the odor trap 100. From there the odor trap 100 forms a channel with a barrier 120, which connects to the outlet 130, to which the drainage channel 220 is connected.

If sufficient water enters into the drain body, water will flow in the odor trap 100 over the barrier 120 when the liquid column above the inlet opening 110 is higher than the barrier 120. This water will reach the drainage pipe 220 via the outlet 130. As a result of the geometry of the swan neck during use a quantity of water always remains in the odor trap, upstream from the barrier 120. As long as this is the case, it is impossible for air from the drainage pipe 220 to escape to the use side via the odor trap.

The channel between the inlet 110 and the outlet 130 is flattened, to minimize the required overall height. It is a disadvantage of this flattening, that the water being drained off encounters a change in the cross-section both upon flowing into the odor trap and upon flowing out of the odor trap. These points turn out to be extremely susceptible to accumulation of impurities, which are found in the drainage water, so that in the long term significant obstructions can be formed here. Furthermore, after building in of the drain body the odor trap is situated under this body and cannot be removed without breaking out the drain body, which makes the cleaning and maintenance of the odor trap more difficult or even impossible.

Figure 2A:
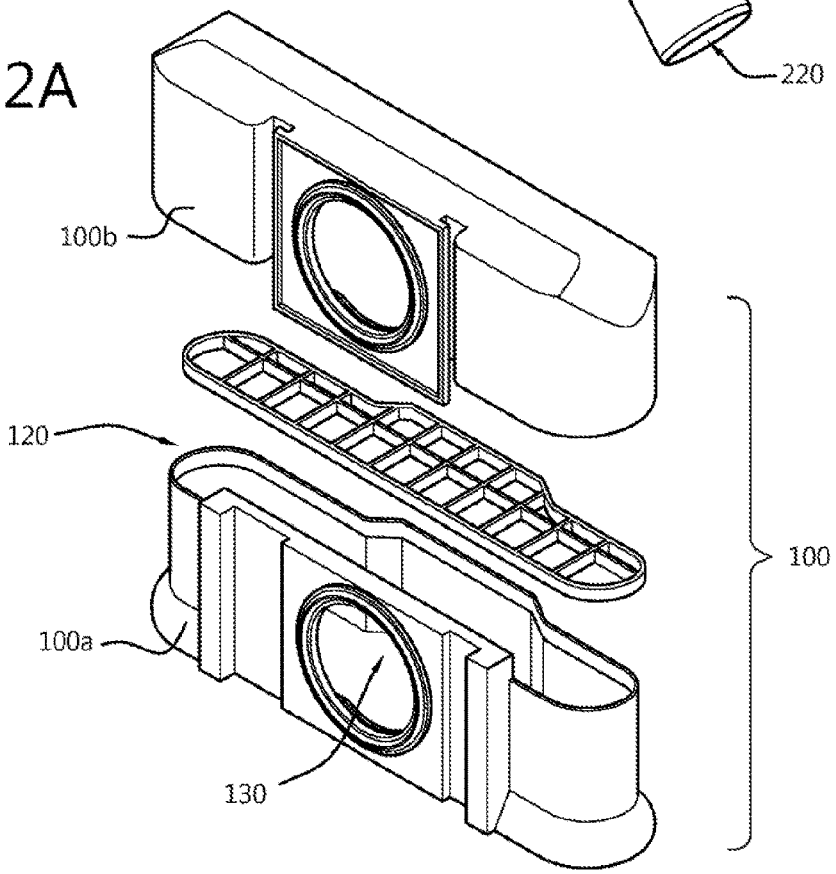
FIGS. 2*a*, 2*b* and 2*c* show a known odor trap of a compacter type.
Figure 2B:
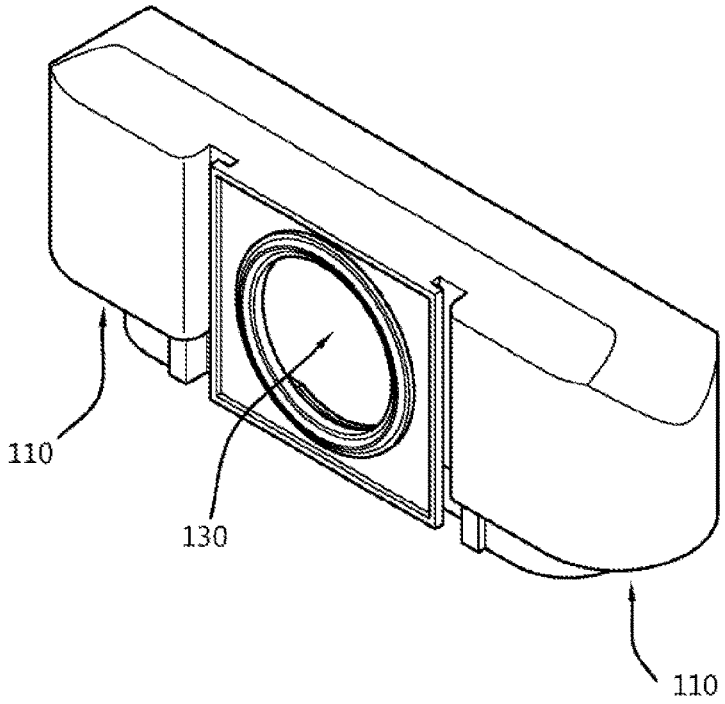

FIG. 2 shows a known odor trap 100, as used in the drain of the "Carrodrain" type.

Figure 2C:
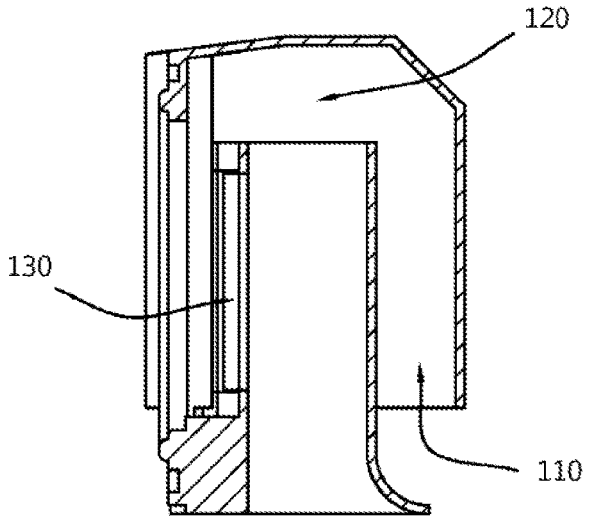

The illustrated odor trap 100 comprises an undermost component 100*a* (in use it rests on the bottom of a recess in the drain body) and an uppermost component 100*b* which is slid over the undermost component. FIG. 2*a* shows the odor trap 100 in perspective in a mounted situation. FIG. 2*c* shows the odor trap 100 in cross-section in a mounted situation.

Over the whole circumference of the odor trap 100 there is an open space between the foot of the undermost component 100*a* and the overhanging part of the uppermost component 100*b*. This open space serves as inlet 110. The odor trap 100 can also be realized in a single component, without deviating from the working principle. However, with pre-existing odor traps, intake over substantially the whole circumference is always chosen, to guarantee a sufficient drainage flow rate. In this way it is also avoided that water, which enters from different sides into the drain body 200, would have to traverse a very different route to eventually flow through the odor trap 100. The outlet 130 is round and intended to be connected to the drainage pipe of the drain body in which the odor trap 100 is situated.

Figure 3:
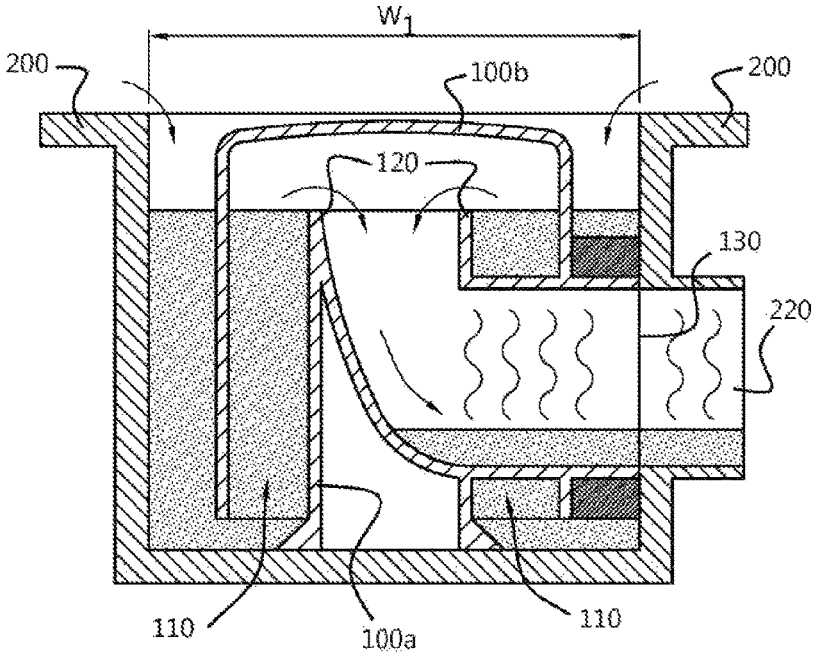
FIG. 3 schematically shows the functioning of the odor trap of FIG. 2.

The working principle of the odor trap of FIG. 2 is schematically shown in FIG. 3.

FIG. 3 is a schematic cross-section of a drain body 200 that is integrated into a floor, such as, for example, the floor of a walk-in shower. The drawing in not to scale and components which are not necessary to an understanding of the working, such as the covering grating of the drain body, are not shown in the drawing.

Upon using the shower, water runs off over the floor to run into the drain body 200 via the edges thereof (curved arrows). The water that collects there, forces its way into the odor trap 100 via the inlet 110, where according to the principle of communicating vessels it assumes the same height as the water which is present around the odor trap 100. The maximum height which can be thus attained, is determined by the height of the barrier 120. If sufficient water comes into the drain body 200, water in the odor trap 100 will flow over the barrier and will reach the drainage pipe 220 via the outlet 130. After use water remains in the drain body up to the height of the barrier 120. The water level will drop over time due to evaporation. However, as long as the water stands higher than the upper edge of the inlet 110, it is impossible for air to escape from the drainage pipe via the odor trap 100.

The geometry of the pre-existing removable odor traps entails that a distance $W_1$ must be bridged at floor level by means of a grating to cover the odor trap 100. Presently, this distance is the limiting factor to making the drains for walk-in showers narrower, because a narrower opening would make it impossible to remove the odor trap 100.

Figure 4:
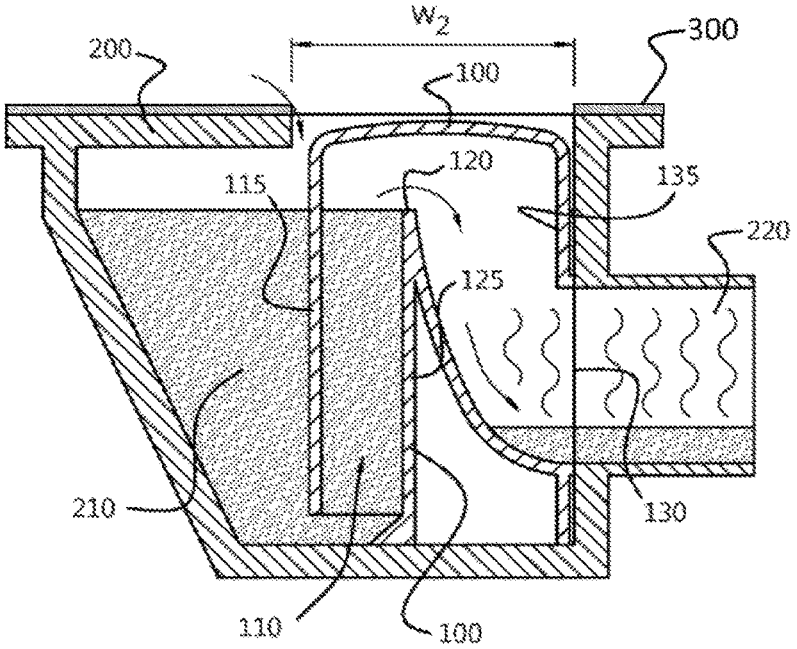
FIG. 4 schematically shows the functioning of the odor trap according to an embodiment of the present invention.

FIG. 4 is a schematic cross-section of a drain body 200 according to an embodiment of the present invention, provided with an odor trap 100 according to an embodiment of the present invention. The drawing is not to scale and components which are not necessary to an understanding of the working, are not shown in the drawing. For corresponding elements the same reference numbers are used as in FIG. 1 and FIG. 2.

In general, the odor trap 100 according to the invention comprises a drainage channel between an inlet 110 and an outlet 130 communicating therewith. The odor trap 100 comprises, viewed in the direction of flow, a first closing wall 115 for closing off an uppermost part of the first drainage channel and a second closing wall 125, situated at a distance from the first closing wall, for closing off an undermost part of the first drainage channel, wherein the first and second closing walls, looked at horizontally, overlap. This combination of partial closing walls forms the actual trap. According to the invention the odor trap 100 is formed as an elongated main body. The odor trap 100 is always designed to be as narrow as possible, so that a particular length is necessary to guarantee a sufficient flow rate.

In a preferred embodiment the main body is substantially box-shaped. The main body can but need not be a perfect box-shape in the geometrical meaning of the word; with "substantially box-shaped" is meant that shape of the body is determined by a pair of parallel planes (the left-side 115 and the right-side 135 of the odor trap in FIG. 4), connected at the top by an upper planar surface which in use is horizontal, and provided at the ends with parallel end surfaces (not visible in FIG. 4). The term "substantially box-shaped" does not exclude the provision of the main body with positioning means, handles, supporting elements for a grating, and such like; that ribs of the main body are rounded or beveled; that the cross-section of the main body at certain places a shape other than a right angle; or that opposing planar surfaces are not perfectly parallel.

The inlet 110 extends over substantially the length of a first planar surface (i.e. an external planar surface) of the main body, which first planar surface is defined by the first closing wall. The inlet may be provided with means to prevent the flowing in of impurities (in particular hair and undesirable objects); which can be a grating or one or more bars. The first plane is thus not fully closed; the absent undermost part constitutes the inlet 110. The second closing wall 125 is situated in the main body. The outlet 130 is situated in a second planar surface of the main body, lying opposite the first planar surface (curved arrows).

When the shower is used, the water runs over the floor, entering the drain body 200 over its whole length across the edges (curved arrows). The water is collected in the collection zone 210, which connects to the recess in which the odor trap is situated, specifically on the side of the inlet 110. The water enters into the odor trap via the inlet 110 at the bottom of the first closing wall 115, where according to the principle of connecting vessels it will attain the same height as the water present in the collection zone 210. The maximum height that can be attained is determined by the height of the barrier 120, which is formed by the second closing wall 125. If sufficient water enters into the drain body 200, water will flow over the barrier 120 in the odor trap 100 and reach the drainage pipe 220 via the outlet 130.

In other words, the barrier 120 in use is higher than the highest point of the inlet 110.

After use water remains in the drain body up to the height of the barrier 120. The water level will drop over time due to evaporation. However, as long as the water is higher than the upper-side of the inlet 110, it is, as a result of the cooperation of the first closing wall 115 and the second closing wall 125 (which, viewed horizontally, overlap), impossible for air from the drainage pipe 220 to escape via the odor trap 100.

In the presented embodiment, the outlet 130 is situated on one side of the odor trap 100, and the inlet 110 extends completely over the opposite side of the odor trap 100.

The geometry of the odor trap according to the invention entails that on floor level only a distance $W_2$ (smaller than $W_1$) has to be bridged using a grating to cover the odor trap 100. Thus a significantly narrower drain is realized.

Figure 5:
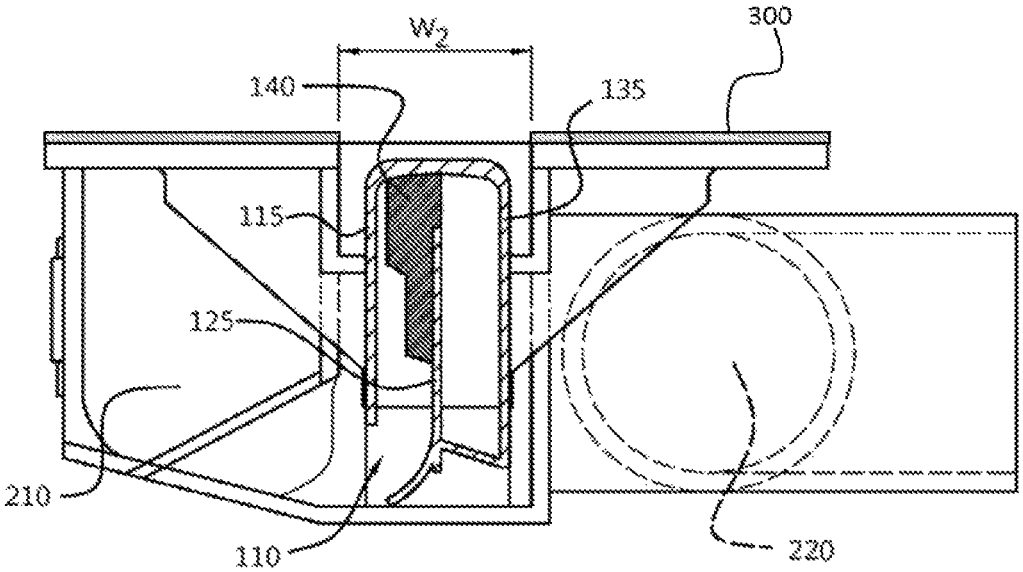
FIG. 5 shows a cross-section of an odor trap according to an embodiment of the present invention.

FIG. 5 shows a cross-section of an odor trap according to a specific embodiment of the present invention. The used reference numbers correspond to those explained in connection with FIG. 3. Since the drawing is meant to illustrate the configuration of the main body, the outlet 130 is not explicitly shown, to avoid the drawing being unnecessarily complicated. The odor trap shown comprises positioning means 140, which in this case are stepped (this is the hatched part in FIG. 5, of which preferably one or more instances with low thickness are provided over the length of the main body, so as not to hinder the above-mentioned working of the odor trap). These positioning means 140 cooperate with a complementary element 240 (see FIG. 7) to ensure that the odor trap is inserted at the correct position, and in particular upon insertion to compress a sealing ring of the outlet sufficiently against a flange of the drainage channel 220 of the drain body or vice versa. Stepped positioning means 140 have the advantage that they provide an automatic and gradual horizontal pressing on of the odor trap as it is pushed down by the user into the recess provided in the drain body 200. Compared with mere beveled positioning means, stepped positioning means 140 have the additional advantage that the resulting normal forces have no significant vertical component, so that the odor trap is not pushed of itself upwards by the forces generated by the gripping.

Figure 6A:
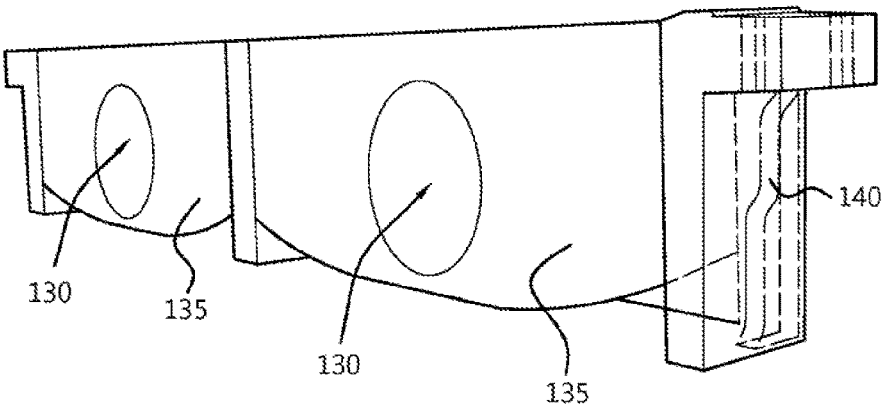
FIGS. 6*a* and 6*b* show perspectives of an odor trap according to an embodiment of the present invention.
Figure 6B:
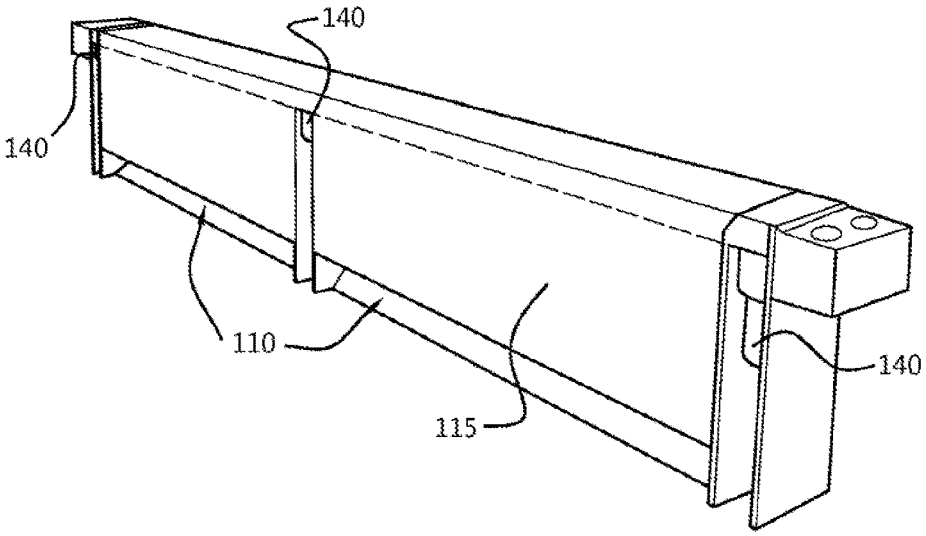

FIG. 6 shows perspectives of an odor trap 100 according to a specific embodiment of the present invention. The reference numbers used correspond to those explained in connection with FIG. 3 and FIG. 5. The uppermost perspective shows the odor trap 100 viewed from the outlet side 135, with the outlet 130. The undermost perspective shows the odor trap from the inlet side 115, with the inlet 110.

Figure 7A:
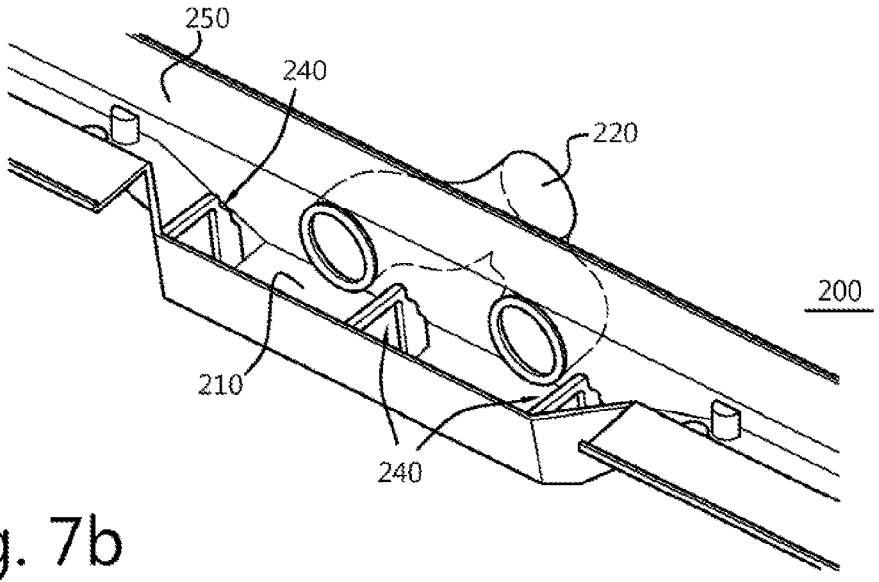
FIGS. 7*a* and 7*b* show a drain body according to an embodiment of the present invention.
Figure 7B:
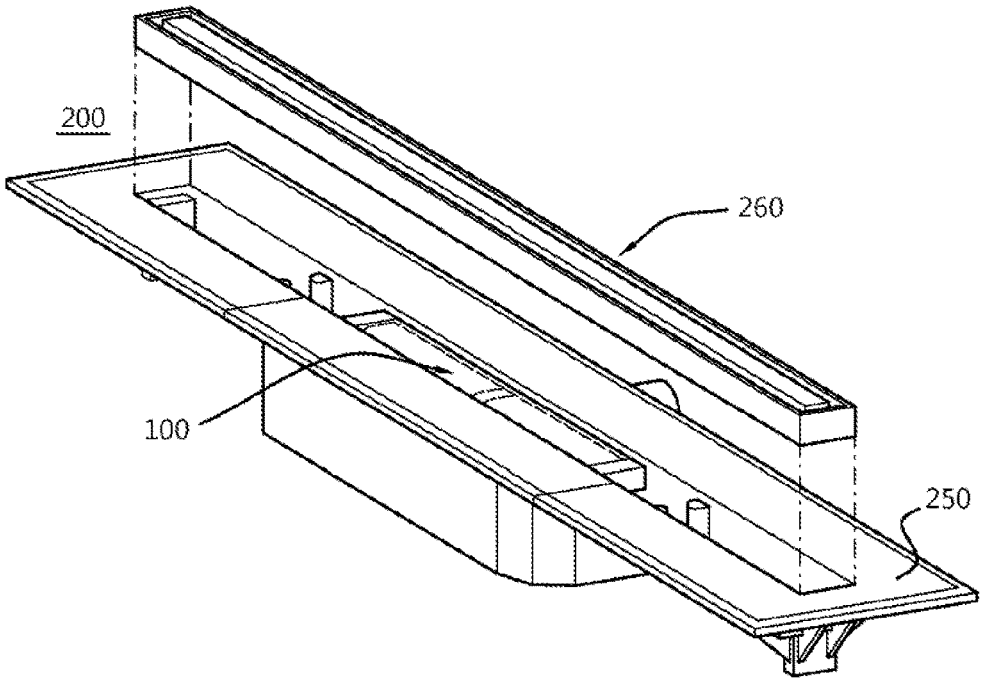

FIGS. 7*a-b* show a drain body according to an embodiment of the present invention. In FIG. 7*a* the drain body 200 is partly shown, without odor trap. In FIG. 7*b*, the complete drain body 200 is shown, with an odor trap 100 inserted in the space provided for that purpose. It can be seen that the odor trap 100 has a length that it is substantially less than that of the drain body 200. Despite this difference in length, an even flow of water can be accommodated over the entire length of the drain body 200 thanks to the presence of the collection zone 210, which collects water arriving from all sides of the drain body 200 at the appropriate side of the odor trap 100, i.e. at the side of the inlet 110. Preferably, the length of the odor trap 100 is less than half of the length of the drain body 200; more preferably, the length of the odor trap 100 is less than one third of the length of the drain body 200. As a result, the part of the drain body 200 which is most susceptible of gathering impurities, and which must be capable of being cleaned easily, is limited to the relatively short zone of the recess and the collection zone 210.

The drain body 200 is intended for building into a floor. It is provided with a recess for receiving an odor trap 100 as described above. The recess is so configured that the outlet(s) 130 of the odor trap connect(s) to a second drainage channel 220 provided in the drain body. Without loss in generality the proposed embodiment has two connections to the drainage channel, with an eye to the use of a compartmentalized odor trap. The drain body 200 is so configured that after building in, the odor trap can still be removed for cleaning, maintenance or replacement. The drain body shown comprises positioning elements 240 which are designed to work together with the positioning means 140 of the odor trap (see FIG. 5).

In the presented embodiment the recess further connects to a collection zone 210 situated at the side of the inlet 110 of the odor trap 100 that is to be inserted. After the drain body has been built in, the collection zone 210 is situated at least partially under the floor covering 300, so that the opening of width $W_2$ that has to be bridged is not influenced thereby. Nonetheless the drain body 200 is configured in such a way that the collection zone is easy to clean, for example with a brush or a water jet, after removal of the odor trap 100 via the recess in the drain body.

According to the present invention an assembly is provided of a drain body 200 according to the invention and an odor trap 100 according to the invention.

The illustrated drain body 200 has a peripheral flange with an upper surface 250 extending substantially in a horizontal plane from its periphery, above which the floor is fitted, for example a tiled floor, a cast floor, or other suitable floor covering 300. On this upper surface 250 a water sealing layer can be adhesively provided, such as described in greater detail in the above-cited Belgian patent BE 1018522 A5, which is incorporated by this reference.

Figure 8A:
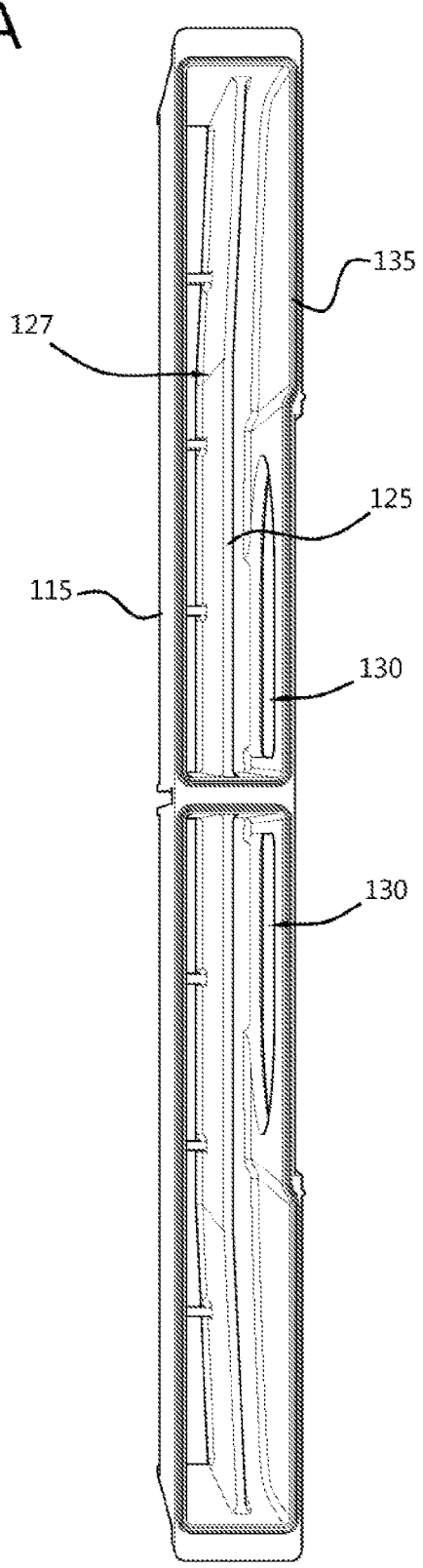
FIGS. 8*a* and 8*b* show a perspective of an odor trap according to another embodiment of the present invention.
Figure 8B:
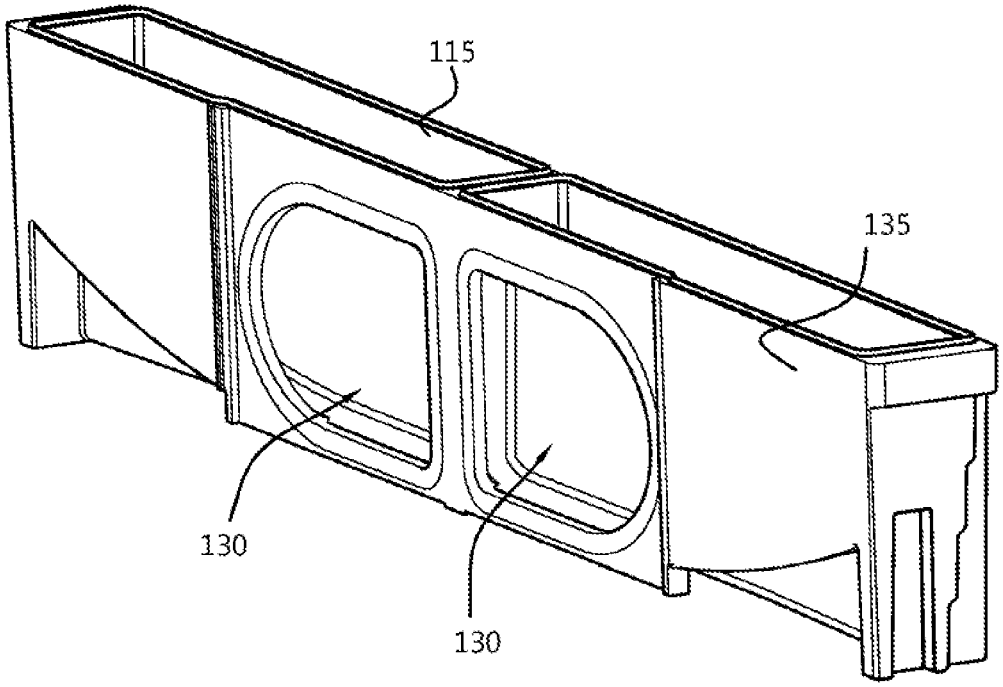

FIGS. 8*a* and 8*b* show perspectives of an odor trap according to another specific embodiment of the present invention. The view illustrated in FIG. 8*a* represents the substantially box-shaped odor trap from its bottom side. The reference numbers used correspond to those explained in connection with FIG. 3, FIG. 5, and FIG. 6. The odor trap comprises, viewed in the direction of flow (top to bottom in this illustration), the first closing wall 115 for closing off the uppermost part of the first drainage channel and the second closing wall 125, situated at a distance from the first closing wall, for closing off the undermost part of the first drainage channel. A further planar surface 135 provides another boundary of the substantially box-shaped main body, and accommodates the outlet openings 130. The second closing wall 125 is thus situated in the main body. The inventors have found that the flow characteristics of the odor trap can be improved by adequate shaping of the second closing wall 125. In the illustrated embodiment, the second closing wall 125 is not a perfect plane parallel to the first closing wall 115 or the outer boundary 135, but presents a change in orientation, directed towards the outlet side, from an inflection point 127 outwards. The second closing wall 125 thus presents a slightly convex surface to the water entering the odor trap from the inlet side. Other arrangements in which the second closing wall 125 presents a convex surface to the water entering the odor trap from the inlet side may be used to obtain a similar improvement of the flow characteristics of the odor trap. FIG. 8*b* shows another perspective of the same odor trap, as viewed from the side of its planar surface 135, which accommodates the outlet openings 130. The shape of the outlet openings 130 is designed to cooperate with the funnel-like connector of FIG. 9.

Figure 9:
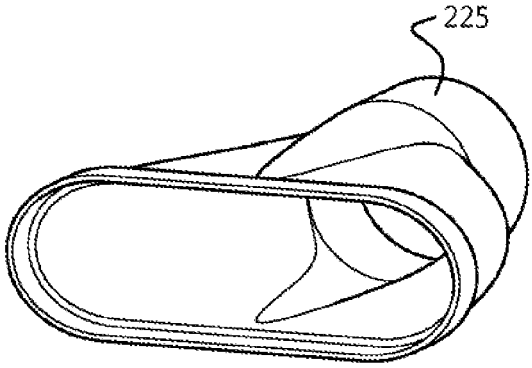
FIG. 9 shows a perspective of a drain pipe connector for a drain assembly according to an embodiment of the present invention.

FIG. 9 illustrates a connector 225 designed to connect an odor trap installed in a drain body to a cylindrical drainage tube. The inventors have found that the flow characteristics of the drain assembly may be further improved by combining a judicious shaping of the outlet orifices 130 of the odor trap, for example according to the shape illustrated in FIG. 8, with a funnel-like connector (instead of the traditional Y-piece). The connector 225 provides a transition from an elongate inlet (connecting to the outside of the drain body 200, in direct communication with the outlets of an installed odor trap 100) to a circular outlet, with minimal flow resistance. As illustrated in FIG. 8, the pair of outlets 130 of the odor trap 100 has the same general shape as the inlet of the connector, except for the presence of the wall that divides the odor trap 100 into compartments. The flow resistance is minimized by making the transition in cross-sectional shape as gradual as possible, and by avoiding a large difference in total cross-sectional area between the inlet and the outlet.

While the invention has been described hereinabove with reference to specific embodiments, this was done to clarify and not to limit the invention. The skilled person will appreciate that modifications of the described arrangements are possible without leaving the scope of the present invention, the scope of which is to be determined by reference to the accompanying claims.

The invention claimed is:

1. A drain assembly, comprising:

an odor trap comprising a first drainage channel situated between an inlet and an outlet, comprising, viewed in the flow direction, a first closing wall for the closing off of an uppermost part of the drainage channel and a second closing wall placed at a distance from the first closing wall, for the closing off of a lowermost part of the first drainage channel, wherein the first and second closing walls, viewed in a horizontal direction, overlap;

wherein the odor trap comprises an elongated main body;

wherein the inlet substantially extends over the length of a first planar surface of the main body, which first planar surface is determined by the first closing wall;

wherein the second closing wall is situated in the main body; and wherein the outlet is situated in a second planar surface of the main body, situated opposite the first planar surface and distant from the second closing wall, whereby water will flow inside the main body over a barrier formed by the second wall towards the outlet in the second planar surface, the second planar surface forming a boundary of the main body; and a drain body for building into a floor opening for being covered partially by a floor covering after the drain body has been built in, the drain body being further provided with a recess for receiving said odor trap, wherein the recess is so configured that the or each outlet of the odor trap connects to a second drainage channel provided on the drain body, wherein the drain body is so shaped that after it has been built in, the odor trap can be removed from the recess, and wherein the recess connects to a collection zone situated at the side of the inlet, which collection zone is situated at least partially under the floor covering after the drain body has been built in.

2. The drain assembly according to claim 1, wherein the main body is substantially box-shaped.

3. The drain assembly according to claim 1, wherein the distance between the first planar surface and the second planar surface is less than 20 mm.

4. The drain assembly according to claim 2, wherein the height of the substantially box-shaped main body is less than 50 mm.

5. The drain assembly according to claim 1, wherein the main body is provided with positioning means.

6. The drain assembly according to claim 1, wherein the outlet is round, and provided with a sealing means to make possible a water-tight connection with a drainage pipe.

7. The drain assembly according to claim 1, provided with at least two compartments, which each have an inlet and an outlet, whereby the at least two compartments are situated abreast.

8. The drain assembly according to claim 5, wherein the drain body is provided with complementary positioning elements for cooperating with the positioning means of the main body.

9. The drain assembly according to claim 1, wherein the odor trap has a length that is less than one third of a length of the drain body.

10. The drain assembly according to claim 1, wherein the second closing wall is not parallel to the first closing wall, but presents a convex surface to an inlet side of the main body.

11. A drain assembly, comprising:

an odor trap comprising a first drainage channel situated between an inlet and an outlet, comprising, viewed in the flow direction, a first closing wall for the closing off of an uppermost part of the drainage channel and a second closing wall placed at a distance from the first closing wall, for the closing off of a lowermost part of the first drainage channel, wherein the first and second closing walls, viewed in a horizontal direction, overlap;

wherein the odor trap comprises an elongated main body;

wherein the inlet substantially extends over the length of a first planar surface of the main body, which first planar surface is determined by the first closing wall;

wherein the second closing wall is situated in the main body; and wherein the outlet is situated in a second planar surface of the main body, situated opposite the first planar surface and distant from the second closing wall, whereby water will flow inside the main body over a barrier formed by the second wall towards the outlet in the second planar surface, the second planar surface forming a boundary of the main body; and a drain body for building into a floor, an upper surface of the drain body extending in a horizontal plane and defining an opening for receiving said odor trap into a recess of the drain body, wherein the recess is so configured that the or each outlet of the odor trap connects to a second drainage channel provided on the drain body, wherein the drain body is so shaped that after it has been built in, the odor trap can be removed from the recess, and wherein the recess connects to a collection zone situated at the side of the inlet, which collection zone is situated at least partially under the upper surface of the drain body.

12. The drain assembly according to claim 11, wherein the upper surface of the drain body is provided with a floor covering.

* * * * *